US006240573B1

(12) United States Patent
Tsai

(10) Patent No.: US 6,240,573 B1
(45) Date of Patent: Jun. 5, 2001

(54) APPARATUS FOR DISPENSING DETERGENT

(76) Inventor: Yu-Chi Tsai, 24-2, Lane 134, Sec. 2, Chungsiao E.Rd., Taipei (TW)

( * ) Notice: Subject to any disclaimer, the term of this patent is extended or adjusted under 35 U.S.C. 154(b) by 0 days.

(21) Appl. No.: 09/479,076

(22) Filed: Jan. 7, 2000

(51) Int. Cl.[7] ..... E03D 9/03
(52) U.S. Cl. ..... 4/227.1; 4/227.3
(58) Field of Search ..... 4/225.1, 226.1, 4/227.1–227.4

(56) References Cited

U.S. PATENT DOCUMENTS 2,065,181 * 12/1936 French ..... 4/227.3
2,722,394 * 11/1955 Titmas ..... 4/227.3
2,772,817 * 12/1956 Jauch ..... 4/227.4
4,066,187 * 1/1978 Nieman et al. ..... 4/227.3
4,915,260 * 4/1990 Jones ..... 4/227.2
5,839,128 * 11/1998 Wang ..... 4/227.2

FOREIGN PATENT DOCUMENTS

148821 * 2/1955 (SE) ..... 4/227.4

* cited by examiner

*Primary Examiner*—Charles H. Eloshway
(74) *Attorney, Agent, or Firm*—Bacon & Thomas, PLLC

(57) ABSTRACT

An apparatus for dispensing detergent into a toilet cistern includes a container, a membrane, a floating body, and a casing. The membrane has two sides that face an entrance of the container and are connected with the floating body, respectively. The floating body is surrounded by the casing, which in turn is connected to the entrance of the container. The floating body is movable up and down within the casing and moves according to a buoyant force due to the water level in the cistern resulting in a variation of the pressure difference inside and outside the container. Thus a well-defined quantity of cleaning liquid is released from the container, as determined by the movement of the membrane.

5 Claims, 4 Drawing Sheets

APPARATUS FOR DISPENSING DETERGENT

BACKGROUND OF THE INVENTION

1. Field of the Invention

The present invention relates to a detergent dispensing apparatus, particularly to a detergent dispensing apparatus that releases a well-defined quantity.

2. Description of Related Art

Toilets with a toilet bowl and a cistern are regularly used in daily life, yet are not easily kept clean. To keep a toilet clean, adding a small amount of a detergent to water is helpful. The detergent is directly applied during manual cleaning or added to water in the water reservoir. Then each flush brings some detergent into the toilet bowl, giving a cleaning effect that is attained without requiring time and manual work.

There are two ways to add detergent to water in a cistern. One is to put cleaning material with dye adsorbed in a holder of inert material into the cistern, forming a solid cleaner block. The cleaning material with dye will then be slowly dissolved in water. A weakening color of the water will indicate that the cleaning material is running out and the cleaner block needs to be replaced. The other way to add detergent to water in a cistern is to place a container holding cleaning liquid inside the cistern. When the water level in the cistern changes, cleaning liquid from the container is dispensed by a dispensing system. However, the two systems just described have disadvantages. The cleaner block gives off cleaning material at a certain rate, leading to a concentration of cleaning material in water that depends on the time elapsed since the toilet was flushed last time. So the cleaning effect of the cleaner block varies with flushing intervals. Furthermore, the right moment to replace the cleaner block is not clearly found. Finally, the cleaner block disintegrates and falls to the bottom of the cistern, dissolving into muddy material which is hard to remove. The container with cleaning liquid does not have the shortcomings of the cleaner block just mentioned, but needs an adequate design of the dispensing system to ensure proper outflowing of cleaning liquid.

Previous patents have disclosed two types of dispensing systems for the container with cleaning liquid which are operated by changing of the water level in the cistern. To connect the container and a floating body, these two types use a moving or control bar and a flexible tube, respectively.

The moving or control bar of the first type has an elongated opening or groove or lateral channels to conduct cleaning liquid. When the water level in the cistern rises, taking along the floating body, the moving bar or control bar is thereby pushed into the container, and cleaning liquid enters the elongated opening or groove or lateral channels. When the toilet is flushed, the water level in the cistern decreases, the floating body is lowered and pulls down the moving or control bar, releasing cleaning liquid into the cistern.

The details of related patents are as follows:

Taiwan patent no. 237056, filed by Guo Zhongyan, uses a groove on a valve bar that is moved between inside and outside the container through a cap by rising and lowering of the water level. Thus a fixed quantity of cleaning liquid is released. Taiwan patent no. 244574, filed by Huang Facai, has a control bar moved with the floating body by a certain amplitude, ensuring that a fixed quantity of cleaning liquid is released. Taiwan patent no. 275894, filed by Zhan Zitong, has a floating body which by buoyancy drives a feeding element upward into the container, where an elongated opening in the feeding element takes in cleaning liquid. When the toilet is flushed, the feeding element goes down, and cleaning liquid is released from the elongated opening. Taiwan patent no. 251605, filed by Li Kunchang, uses a floating body, having a cross head bolt and a ball, which moves upward and downward with the water level in the cistern, so that cleaning liquid flows through lateral channels in the cross head bolt according to the upward and downward movement thereof. Taiwan patent no. 351365, filed by Huang Facai, has a bar, moving upward and downward with the water level in the cistern, with a plug regulating the released quantity of cleaning liquid, for automatic flowing and blocking at appropriate times.

The moving or control bars in the patents explained above glide through the cap of the container between the inside and the outside thereof. Too tight a contact with the cap causes too much friction, too loose a contact causes dripping out or leaking of cleaning liquid into the cistern, so that after a long flushing interval too high a concentration of cleaning liquid has entered the cistern. This is both uneconomical and bad for the environment.

In order to solve the problem of dripping or leaking cleaning liquid, upper and lower plugging rings are inserted as seals, or a sealing ring is used at the container outlet. However, due to gliding structural parts, effective sealing is not attained, and stable dispensing of cleaning liquid is not realized.

The details of related patents are as follows:

Taiwan patents no. 289366 and 340546, filed by Liao Lirong, have a container, a connecting piece, a flexible tube and a floating body. The floating body is raised or lowered according to the water level in the cistern. With the floating body experiencing a buoyant force along with the water level rising, the flexible tube is taken along, driving a shutter element that causes liquid inside the container to flow out through a hole in the connecting piece into the cistern. The floating body and the flexible tube have a watertight connection. In another file, a protective cap is added which, by a determined distance from the container, controls the quantity of outflowing liquid.

The patents just described teach, with the flexible tube forming a connection between the container and the floating body how to avoid leaking of cleaning liquid by a principle of pressure balance. However, when the cistern is full of water, a connection is established to liquid in the conduit between the container entrance and the flexible tube, and the pressure balance is upset. Since cleaning liquid in high concentration often has a higher density than water, cleaning liquid will slowly seep into the conduit between the container entrance and the flexible tube. Furthermore, when lifted by the water level rising, the floating body possibly is tilted, resulting in a not well-defined quantity of cleaning liquid to be released and resulting in the need to install another protective cap.

SUMMARY OF THE INVENTION

The present invention relates to a detergent dispensing apparatus, particularly to a detergent dispensing apparatus that releases a well-defined quantity. The present invention comprises a container, a membrane, a floating body, and a casing. The membrane has two sides that face an entrance of the container and are connected with the floating body, respectively. The floating body is surrounded by the casing, which in turn is connected to the entrance of the container.

The floating body is movable up and down within the casing and moves according to a buoyant force due to the water level in the cistern, taking along the membrane, resulting in a variation of the pressure difference inside and outside the container. Thus a well-defined quantity of cleaning liquid is released from the container, as determined by the movement of the membrane.

The present invention allows to dispense cleaning liquid into a toilet cistern in defined quantities. Further ingredients, like aromatic substances, may be added to the cleaning liquid to attain a hygienic effect. With every flush of the toilet the released quantity of cleaning liquid is constant, without any need for an expensive regulating system, e.g. an electronic control system. The present invention has a simple structure and provides a cheap and effective cleaning liquid dispensing system for toilets.

The main object of the present invention is to provide a detergent dispensing apparatus which dispenses a cleaning liquid in constant quantities, without dripping or leaking of the cleaning liquid.

Another object of the present invention is to provide a detergent dispensing apparatus which allows to use cleaning liquid of high concentration to be dispensed in small quantities.

A further object of the present invention is to provide a detergent dispensing apparatus which is usable in cisterns of varying dimensions and wall thicknesses and inclinations.

The present invention can be more fully understood by reference to the following description and accompanying drawings.

DETAILED DESCRIPTION OF THE PREFERRED EMBODIMENT

Figure 1:
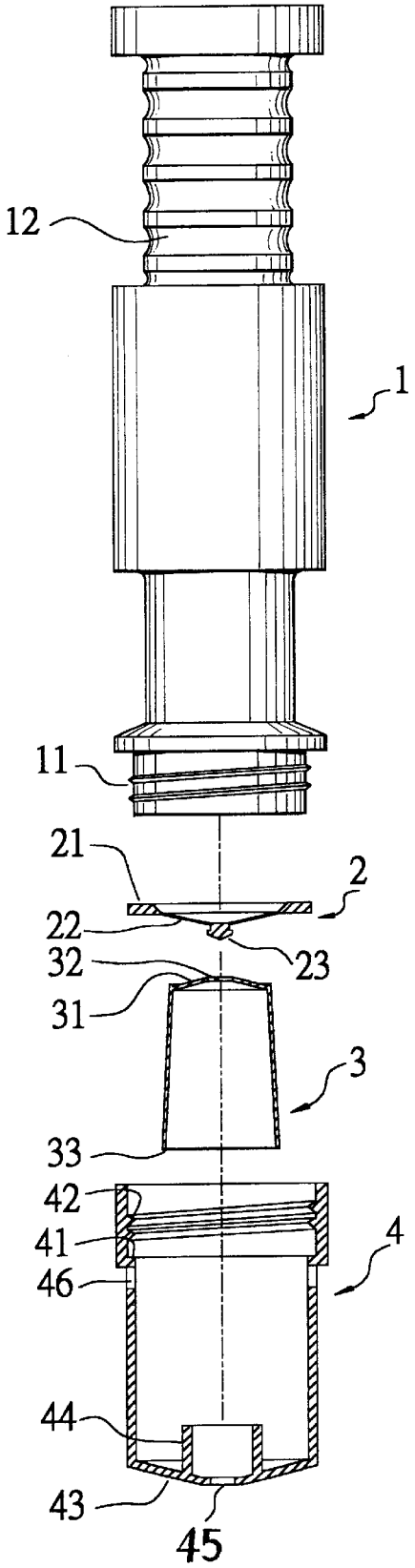
FIG. 1 is a sectional side view of the detergent dispensing apparatus of the present invention when disassembled.
Figure 2:
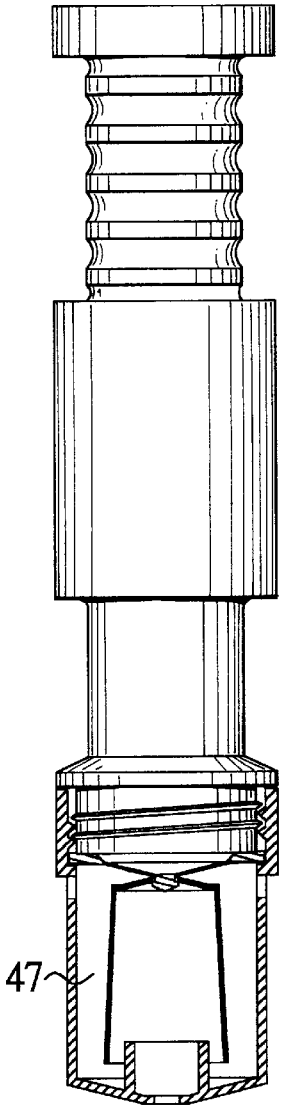
FIG. 2 is a sectional side view of the detergent dispensing apparatus of the present invention when assembled.

The detergent dispensing apparatus of the present invention is mounted in a cistern of a toilet containing water with a water level and is used to release constant quantities of cleaning liquid into the cistern after the toilet is flushed. As shown in FIGS. 1 and 2, the detergent dispensing apparatus of the present invention in a first embodiment mainly comprises: a container 1; a membrane 2; a floating body 3; and a casing 4. The container has a periphery and a lower end with an entrance 11. The membrane 2 has an upper side that faces the container 1 and is mounted on the entrance 11, forming a watertight connection with the entrance 11. The membrane 2 further has a lower side which is connected with the floating body 3 on an upper end thereof. The casing 4 has an upper end which is fastened to the entrance 11 of the container 1, extending downward therefrom. The floating body 3 is surrounded by the casing 4, being movable therein.

The membrane 2 is made of silicon, rubber or another high-polymer that is soft and resistant against chemical substances. The membrane 2 has a relatively thick periphery 21 to reinforce the membrane 2 where connected with the entrance 11. The lower side of the membrane 2 has a center with a downward projection 23. One or several holes 22 are cut through the membrane 2 between the periphery 21 and the projection 23 thereof. To connect with the container 1 and to ensure a watertight connection between the membrane 2 and the entrance 11 of the container 1, the casing 4 has an inner shoulder 41 at the upper end thereof. When the casing 4 is mounted on the entrance 11 of the container 1, the shoulder 41 presses on the periphery 22 of the membrane 2, ensuring a watertight connection of the container 1 and the membrane 2. Cleaning liquid is stored in the container 1. When the membrane 2, being flexible, is bent upward, the holes 22 allow the cleaning liquid to pass. Without upward pressure on the membrane 2, the cleaning liquid presses on the upper side of the membrane 2, and the membrane 2 is bent downward. Then, to balance pressures inside and outside the container 1, air enters the container 1 through the holes 22. Balance of pressures inside and outside the container 1 ensures that no cleaning liquid will drip out of the container 1.

The floating body 3 is shaped like a cup turned upside down with an open lower end 33. The floating body 3 has on the upper end thereof a top area 31 shaped like a cone, with a central depression 32 placed therein. The projection 23 fits into the depression 32, connecting the membrane 2 and the floating body 3. Other ways to connect the membrane 2 and the floating body 3, like gluing, are possible, as well. Preferably, however, for easy mounting and reliable quality the projection 23 on the membrane 2 and the depression 32 on the floating body 3 are employed. The floating body 3 is buoyed by water in the cistern. When the water level rises beyond the lower end 33, air in the floating body 3 is unable to leave, and the floating body is taken upward.

The casing 4 has an inner thread 42 above the shoulder 41 which engages with an outer thread on the entrance 11 when the casing 4 and the container 1 are connected. The casing 4 has a peripheral wall and a bottom 43, from which a positioning ring 44 extends upward. The floating body 3 on the lower end 33 thereof fits loosely between the peripheral wall and the positioning ring 44 of the casing 4, allowing liquid to flow in between. The positioning ring 44 extends far enough to be always surrounded by the lower end 33 of the floating body 3. Between the peripheral wall of the casing 4 and the floating body 3, a buffer space 47 is formed. The buffer space 47 takes in cleaning liquid that has flown out of the container 1 through the holes 22, rather that allowing cleaning liquid to flow directly into the cistern. A central outlet hole 45 in the bottom 43 of the casing 4 provides a conduit for cleaning liquid in the buffer space 47 into the cistern. One or several ventilating holes 46 in the peripheral wall of the casing 4 close to the upper end thereof, allowing air to escape out of the buffer space 47 when the water level rises.

Figure 3A:
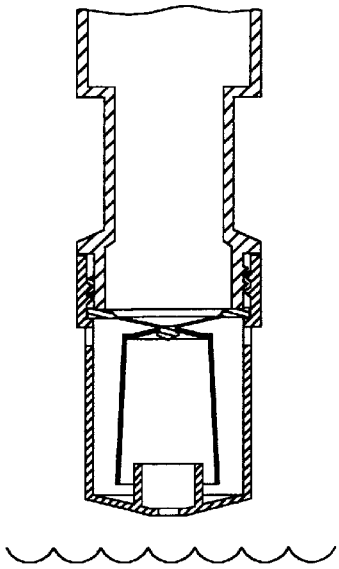
FIG. 3 is a schematic illustration of the detergent dispensing apparatus of the present invention, with water in the cistern rising.
Figure 3B:
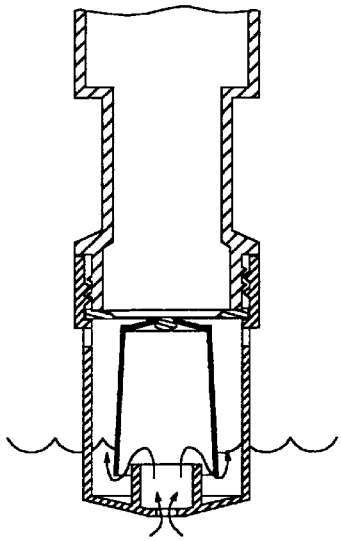
Figure 3C:
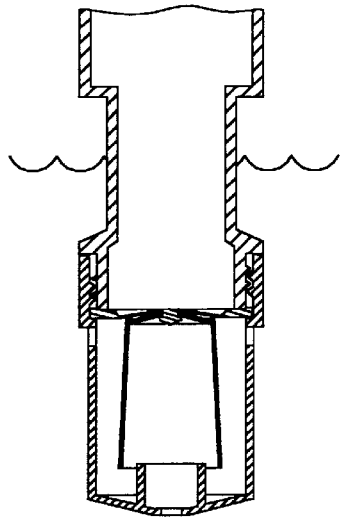
Figure 4A:
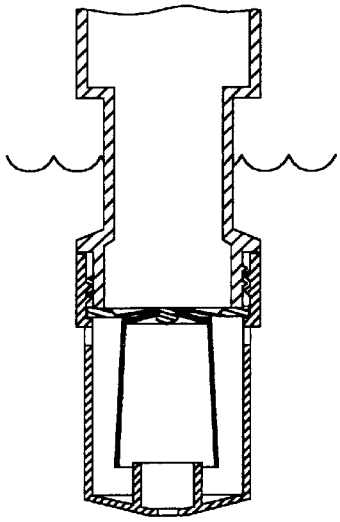
FIG. 4 is a schematic illustration of the detergent dispensing apparatus of the present invention during flushing of the toilet.

Referring to FIGS. 3 and 4, the present invention works as follows. When the cistern is refilled after flushing the toilet, the water level is below the bottom 43 of the casing 4, as shown in FIG. 3*a,* and the buffer space 47 is empty of cleaning liquid. With the water level rising above the bottom 43 of the casing 4, as shown in FIG. 3*b,* the floating body 3, with no way for air trapped therein to escape, is pushed upward, in turn bending upward the membrane 2. At this time the top area 31 does not yet cover the lower side of the membrane 2 and the holes 22, such that cleaning liquid flows out of the container 1 through the holes 22 into the buffer space 47, mixing with water there. When the water level has risen above the upper end of the casing 4, as shown in FIG. 3*c,* the floating body 3 has risen far enough that the top area 31 thereof covers the lower side of the membrane 2 and seals the holes 22. Then no cleaning liquid comes out of the container 1. In this state, the cistern is refilled with water, waiting for the next flush. Since no cleaning liquid drips out or leaks of the container 1, the concentration of cleaning liquid in the water of the cistern remains unchanged with time. In other words, a constant quantity of cleaning liquid is dissolved in the water of the cistern, ready for the next flush.

Figure 4B:
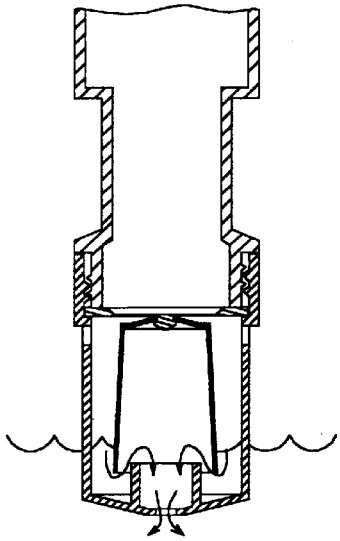
Figure 4C:
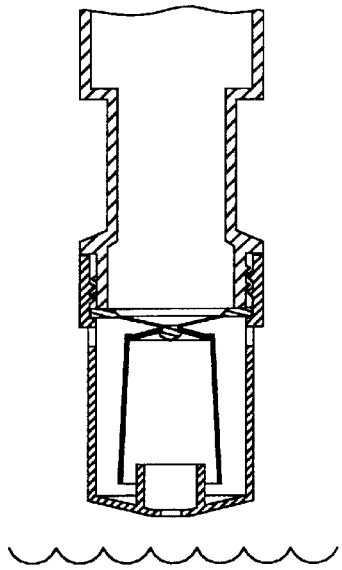

When the toilet is flushed, the water level in the cistern is lowered, and a major part of the water in the cistern flows into the toilet bowl. As shown in FIG. 4*b,* when during flushing of the toilet the water level passes the upper end of the casing 4, all remaining cleaning liquid in the buffer space 47 flows out through the outlet hole 45 into the cistern. When the water level sinks below the bottom 43 of the casing 4, as shown in FIG. 4*c,* all cleaning liquid in the buffer space 47 flows out completely, after a major part of the water in the cistern has flown into the toilet bowl. Only a minor part of the water in the cistern is left, mixing with cleaning fluid that has flown out of the buffer pace 47. With a fixed quantity of cleaning fluid dissolved in a relatively small quantity of water, a higher concentration of cleaning liquid is achieved, which leads to an improved cleaning effect. In other words, the present invention provides a better cleaning effect with a smaller quantity of cleaning liquid.

When the floating body 3 is no longer buoyed by water in the cistern, the membrane 2 is bent downward by the weight of cleaning liquid in the container 1, lowering pressure inside the container 1. Then air is sucked in through the ventilating holes 46 and the holes 22, replenishing volume lost when cleaning liquid flowed out last time, until a pressure balance is established between inside and outside the container 1. In this state, no cleaning liquid flows out of the container 1, held back by the pressure balance. Thus it is ensured that no cleaning liquid is added to the buffer space 47 and the quantity of cleaning liquid to be used next time the toilet is flushed remains unchanged.

Figure 5:
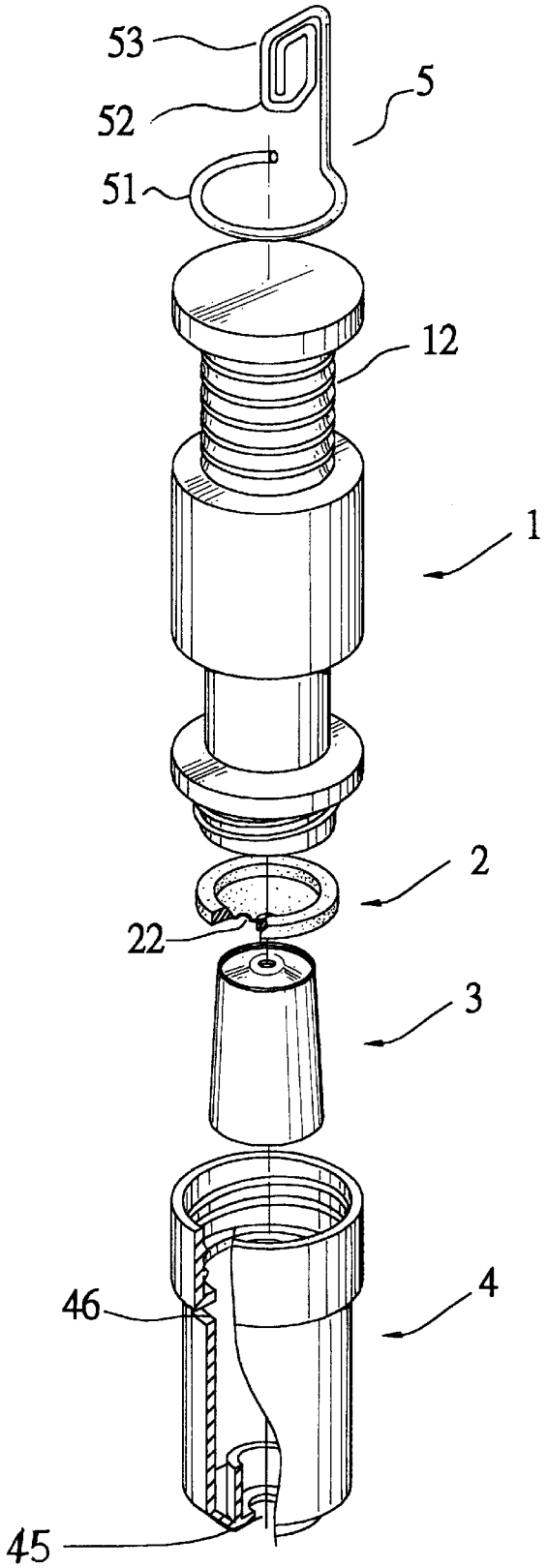
FIG. 5 is a perspective view of the present invention with the mounting device when disassembled.
Figure 6:
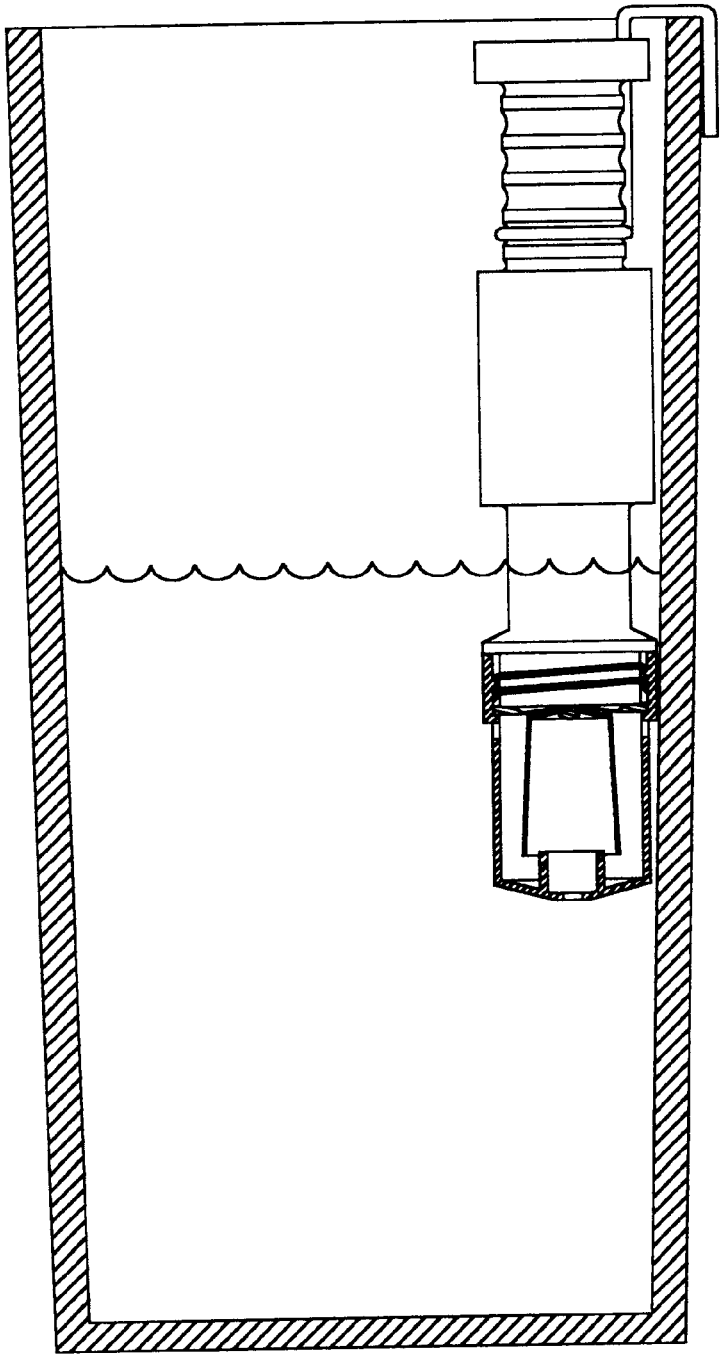
FIG. 6 is a side view of the present invention mounted in a cistern.

Referring to FIGS. 5 and 6, for using the detergent dispensing apparatus of the present invention, the container 1, the membrane 2, the floating body 3 and the casing 4 are assembled and placed in the cistern. Changing the water level in the cistern during refilling and flushing respectively raises and lowers the floating body, bending the membrane upward and downward, thereby controlling the quantity of cleaning liquid dispensed. To work properly, the detergent dispensing apparatus of the present invention has to be submerged completely in water while the cistern is completely filled with water. However, cisterns on the market have varying dimensions and walls with varying thicknesses and inclinations.

To accommodate various cisterns, the detergent dispensing apparatus of the present invention has a mounting device 5. The mounting device 5 comprises a holding ring 51 and a clasp 52. The periphery of the container 1 has horizontal holding grooves 12 which partly or completely run around the container 1. The holding ring 51 fits around any of the holding grooves 12. To adjust the detergent dispensing apparatus for a vertical position within the cistern, one of the holding grooves 12 in an appropriate position is put inside the holding ring 51. The clasp 52 has a horizontally oriented central part 53, continuing as sections that are placed inside and outside one of the walls of the cistern. Thus the clasp is twisted and develops an elastic force. The elastic force holds the clasp 52 firmly on the cistern, independent of the thickness of the walls thereof. Any inclination of the walls of the cisterns will not influence the hold of the mounting device. Therefore, the detergent dispensing apparatus of the present invention is mountable in cisterns of varying dimensions and walls with varying thicknesses and inclinations.

While the invention has been described with reference to a preferred embodiment thereof, it is to be understood that modifications or variations may be easily made without departing from the spirit of this invention which is defined by the appended claims.

What is claimed is:

1. A detergent dispensing apparatus, mounted in a cistern of a toilet containing water with a water level, said detergent dispensing apparatus comprising:

a container, storing liquid detergent, having a lower end with an entrance;

a membrane, having an upper side, facing said container, a lower side with a central, downward extending projection, a relatively thick periphery as a reinforcement and one or several holes between said projection and said periphery, said membrane at said periphery being mounted on said entrance of said container;

a floating body, shaped like a cup turned upside down, having a lower end and a cone-shaped top area which is connected with said projection of said membrane; and a casing, having an upper end with an inner thread which is mounted on said entrance of said container, a peripheral wall with ventilating holes close to said upper end, and a bottom with a central outlet hole and an upward extending positioning ring, said floating body being accommodated inside said peripheral wall, with said lower end thereof outside said positioning ring, and with a buffer space left between said peripheral wall and said floating body;

wherein said floating body is pushed upward when said cistern is refilled with water, bending said membrane upward, resulting in a certain quantity of detergent flowing out of said container.

2. A detergent dispensing apparatus according to claim 1, wherein said top area of said floating body has a central depression into which said projection fits.

3. A detergent dispensing apparatus according to claim 1, wherein said membrane is made of a material that is soft and resistant against chemical substances.

4. A detergent dispensing apparatus according to claim 1, wherein said container has horizontal holding grooves which partly or completely run around said container.

5. A detergent dispensing apparatus according to claim 4, further comprising a mounting device, having a holding ring and a clasp, wherein, for mounting said detergent dispensing apparatus at a desired vertical position within said cistern, said holding ring is put around one of said holding grooves that is suitable with regard to said vertical position and said clasp is set on a wall of said cistern.

* * * * *